United States Patent [19]

Karpinsky

[11] 4,232,591

[45] Nov. 11, 1980

[54] CARTON ERECTING APPARATUS

[75] Inventor: William J. Karpinsky, Audubon, Pa.

[73] Assignee: Container Corporation of America, Chicago, Ill.

[21] Appl. No.: 5,303

[22] Filed: Jan. 22, 1979

[51] Int. Cl.[3] ..... B31B 1/80

[52] U.S. Cl. ..... 493/314; 493/409

[58] Field of Search ..... 93/53 R, 53 SD; 53/564, 53/566

[56] References Cited

U.S. PATENT DOCUMENTS

| | | | |
|---|---|---|---|
| 2,541,607 | 2/1951 | Piazze | 93/53 R |
| 3,728,945 | 4/1973 | Vuilleumier | 93/53 R |
| 3,896,711 | 7/1975 | Vuilleumier | 93/53 SD |
| 4,011,799 | 3/1977 | Chidsey | 93/53 SD |

*Primary Examiner*—James F. Coan

*Attorney, Agent, or Firm*—Richard W. Carpenter

[57] ABSTRACT

An apparatus for erecting flattened carton tubes is disclosed. The apparatus includes a hopper holding flattened carton tubes and a conveyor for receiving erected tubes transferred thereto by vacuum pick-off and transfer means moving in a predetermined path between the hopper and the conveyor. The air pressure is supplied through stationary plenum means.

2 Claims, 8 Drawing Figures

CARTON ERECTING APPARATUS

SUMMARY OF THE INVENTION

The invention relates to an apparatus for erecting folding carton tubes by the application of air pressure against at least one of the ends of a tube somewhat similar to the teachings of U.S. Pat. Nos. 3,728,945, 3,896,711 and 4,011,799, all assigned to the assignee of the present invention.

In U.S. Pat. No. 3,728,945, air pressure is used to erect a carton tube after the tube has been deposited on an endless conveyor. The plenum is located along the conveying means.

In U.S. Pat. No. 3,896,711, air pressure is used to erect a carton tube while it is being transferred from a hopper to a conveyor. The apparatus has a constricted throat portion on the hopper for partially erecting the carton before it passes a fixed plenum.

In U.S. Pat. No. 4,011,799 the transfer of a carton tube from a hopper to a conveyor is achieved by transfer means required to move in two arcuate paths, one of said paths being for carton tube pickoff and the other for placement of the erected tube on the conveyor. Here, the plenum moves in the same arc as the transfer means.

According to the present invention, the erection of a carton tube and transfer of same from a hopper to a conveyor is achieved by a vacuum pick-off and transfer structure movable in a path and cooperating with a stationary plenum acting during at least a portion of the movement for applying air pressure against at least one end of said tube to erect the same as it is moved from the hopper to the conveyor.

THE DRAWINGS

Figure 1:
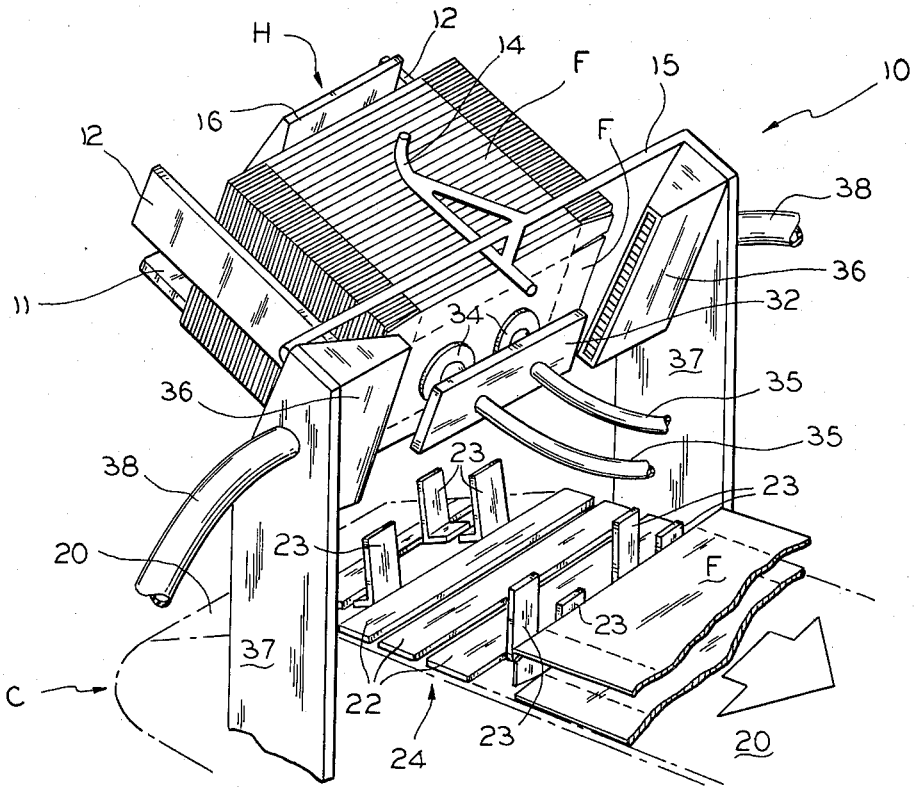
FIGS. 1, 2, 3 and 4 are fragmentary isometric views illustrating apparatus embodying the features of the present invention and sequentially showing the cartons in various stages of being erected from a flat condition.

Referring now to the drawings, there is shown an embodiment of the invention referred to generally by the reference numeral 10.

Only the essential features of the apparatus of the present invention are illustrated. The specific structural details are not shown since they may be of conventional design well known in the art.

A plurality of flat folded carton tubes F are stacked in a hopper H which includes a shelf 11 supporting the carton tubes F between the spaced arms 12 engaging the ends of the tubes. A hold-down plow 14 attached to a bar 15 holds the tubes in the hopper. A pusher plate 16 advances the tubes F toward the transfer mechanism described in greater detail later.

The hopper H is positioned over a conveyor C which includes an orbitally movable chain or belt 20 having flights 22 thereon which together with trapping lugs 23 define pockets 24 of identical size for trapping an erected carton tube F therein.

A feature of the invention resides in a carton erecting and transfer mechanism mounted over a conveyor C for movement between the hopper H and the conveyor C.

FIGS. 1 through 4 show a vertical distance between the hopper H and the conveyor C shorter than actual so as to cut down on the size of these figures.

For the purpose of clarity, only a portion of the structural details of the transfer mechanism are shown, and include a laterally extending frame 32 supporting one or more vacuum pick-off devices 34 connected to a vacuum source by hoses 35, or the like.

A structure is provided for directing a blast of air against the ends of the carton tubes F, and includes stationary plenum members 36 each supported on an upright frame 37. The members 36 are connected to a source of pressurized air by supply hoses 38.

The frame 32 is mounted on arms, not shown, which swivel with the frame in timed relationship to the conveyor C so as to place an erected tube F into a pocket 24. Means for causing the swiveling movement of the arms are not shown since such means are believed to be within an ordinary skill of a mechanical designer.

Figure 4:
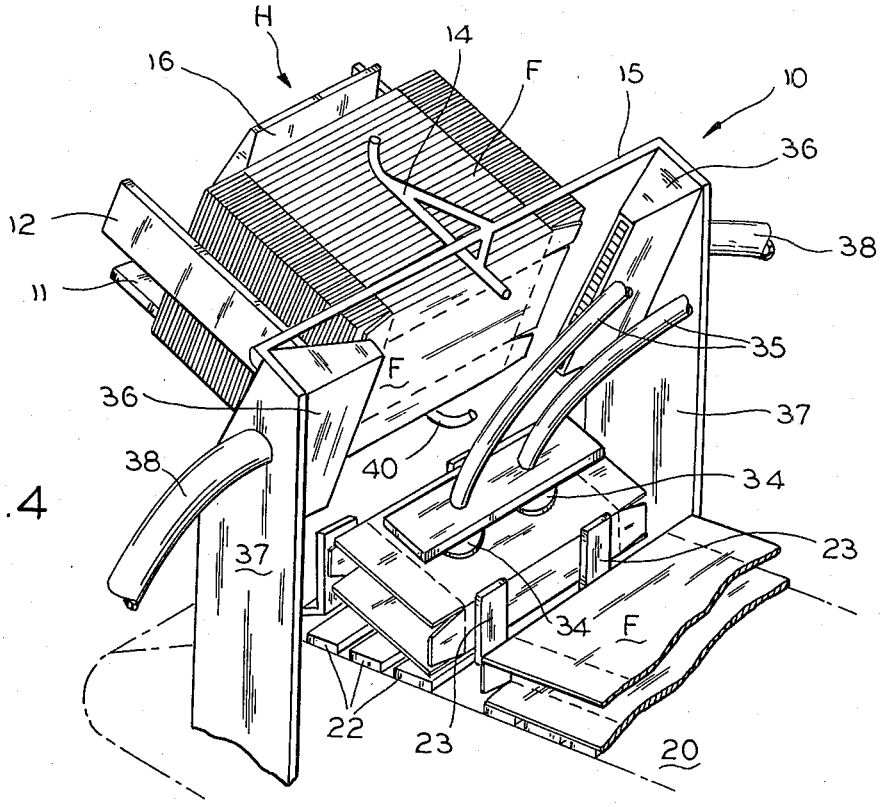

A guide member 40, best seen in FIG. 4, is operatively attached to the apparatus of the present invention and provides a guide to assist in erecting the cartons F from the flattened condition best seen in FIG. 1.

In the general operation of the apparatus a blast of air is directed from the plenum or plenums 36 against the end or ends of the carton F, as it moves past the plenum. This causes the flattened carton tube to be erected. A further movement of the carton held by the vacuum pick-off devices 34 places the erected carton on the conveyor C where it is received in the pocket 24 and held therein by the lugs 23 while it is being advanced by the conveyor. When the carton reaches the pocket 24, the vacuum is disconnected from the pick-off devices 34 thereby releasing the erected carton.

The more specific operation of the apparatus can be best understood by a reference to the illustrations contained in the drawings.

The beginning of the operation can be observed in FIG. 1 where the vacuum pick-off devices 34 move a flattened carton F from the hopper H past the stationary plenum members 36 in an arcuate path.

Figure 2:
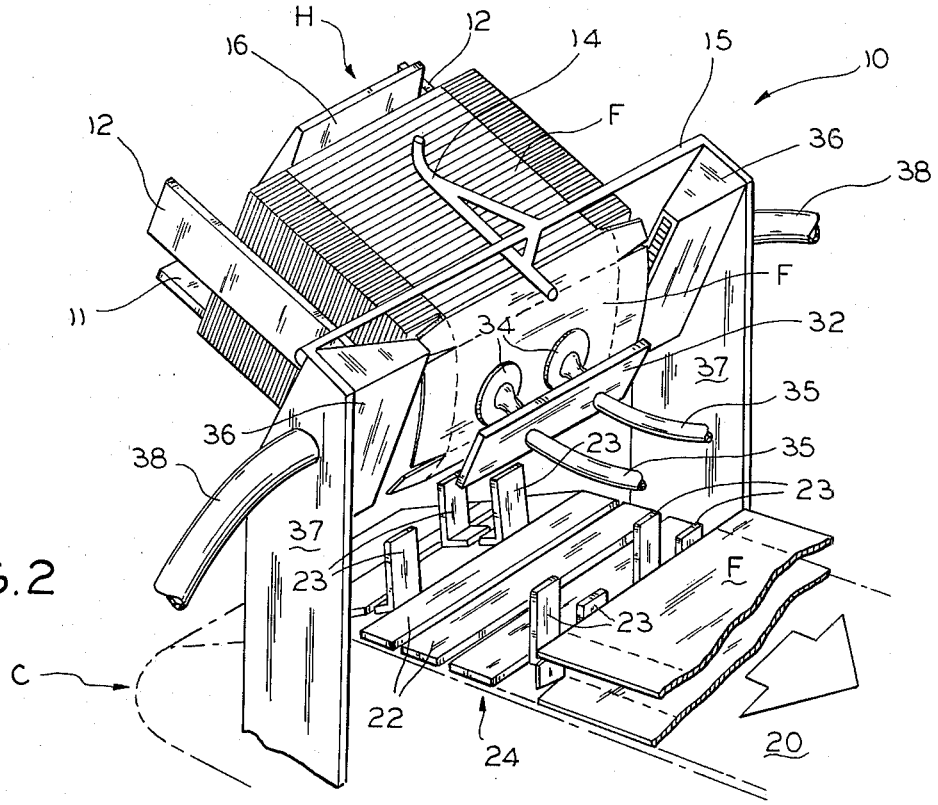
Figure 3:
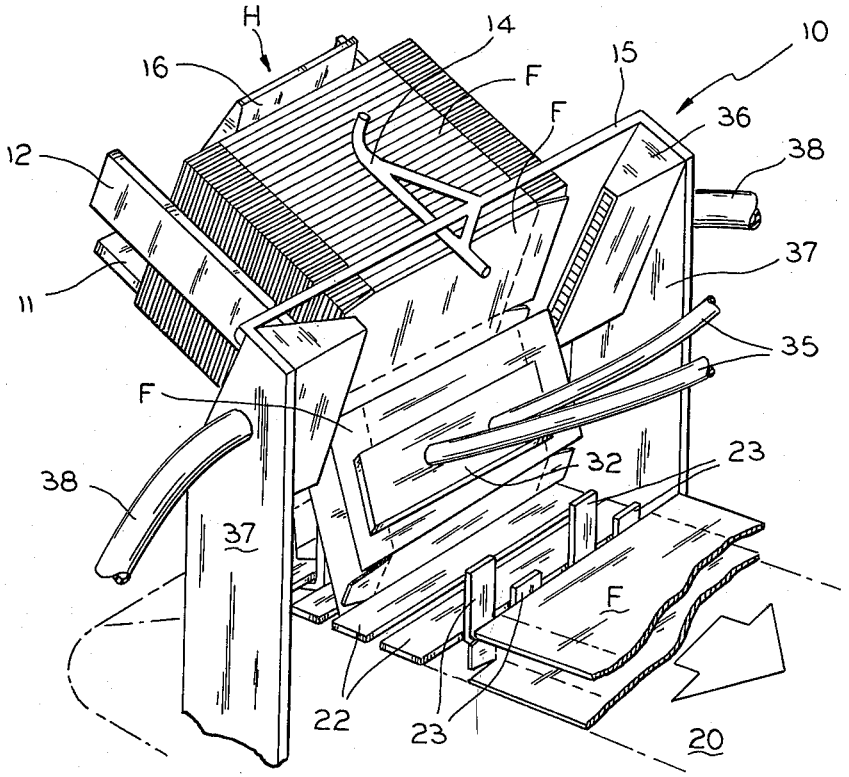

FIG. 2 illustrates the flattened carton F being pulled by the devices 34 past the plenum members 36, but here the carton F is beginning to balloon open. FIG. 3 illustrates the next step in the erecting sequence and shows the carton in a partially erected condition.

FIG. 4 illustrates an erected carton F being placed into the pocket 24 on the conveyor belt 20. The trailing lugs 23 come up behind the carton to trap it and hold it in shape.

Several embodiments of the apparatus are shown in FIGS. 5–8.

Figure 5:
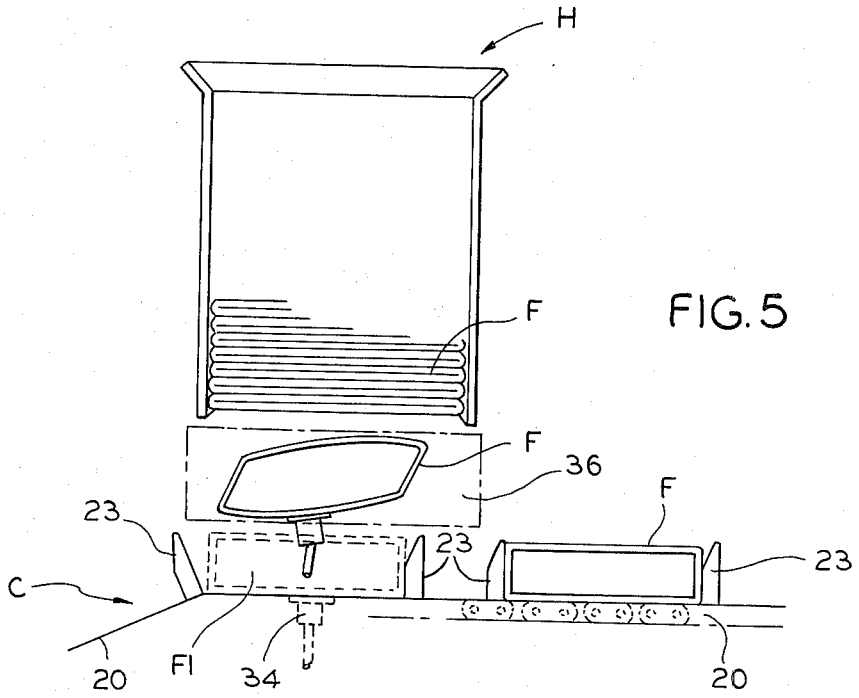
FIG. 5 is a schematic view illustrating the movement of a carton being drawn straight down onto the conveyor past the fixed plenums.

In the embodiment illustrated in FIG. 5, the carton F is drawn by the pick-off devices 34 straight down onto the conveyor C past the fixed, or stationary plenums 36 by an up-and-down reciprocating movement. F1 indicates a position of the carton F at the bottom of the stroke of the pick-off devices 34.

Figure 6:
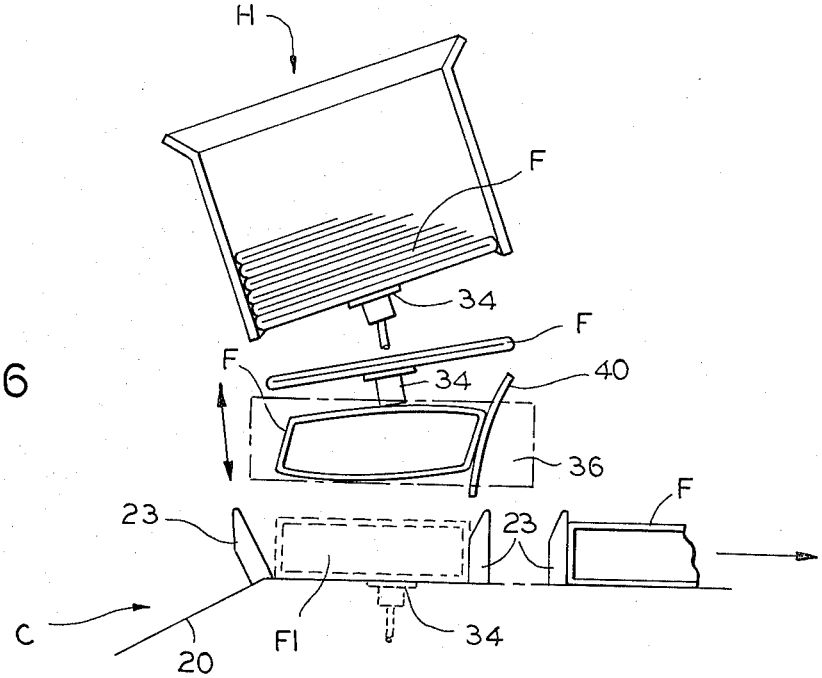
FIG. 6 is a schematic view illustrating another embodiment where a carton is drawn down in a shallow arc onto the conveyor and past the fixed plenums.

FIG. 6 presents an embodiment where the carton is drawn down in a shallow arc, past the stationary plenum 36 and onto the conveyor C. F1 indicates the position of the carton at the bottom of the stroke of the pick-off devices 34.

Figure 7:
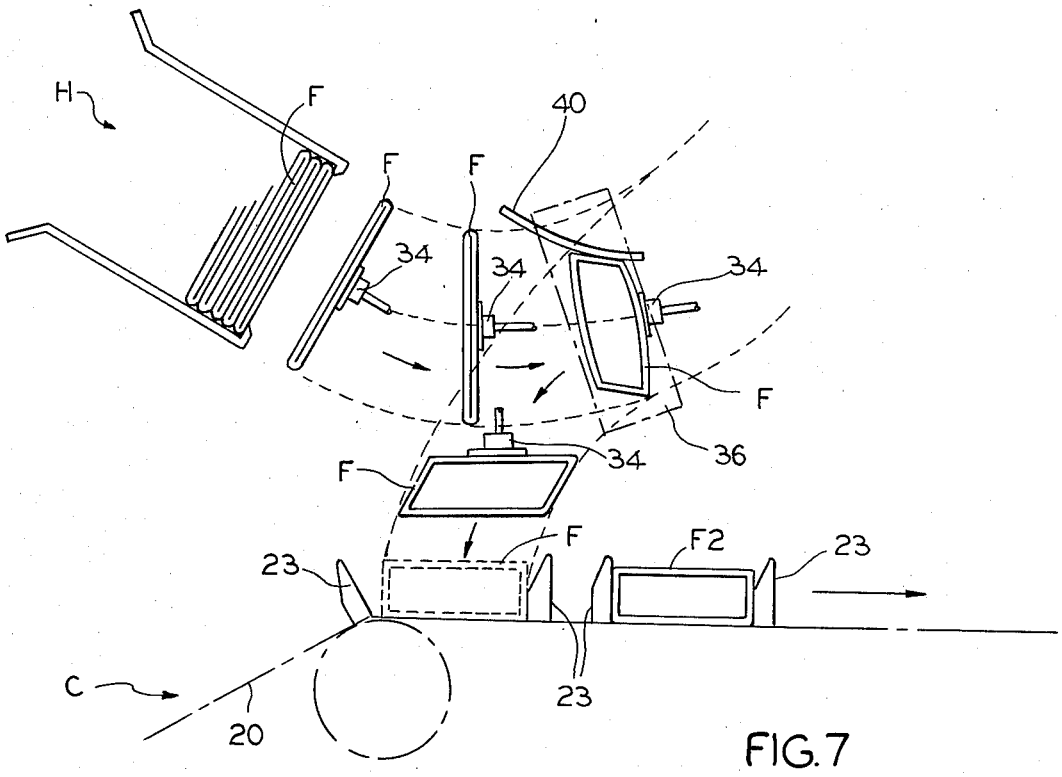
FIG. 7 is a schematic view illustrating a double arcuate path through which a carton is moved.

FIG. 7 illustrates a further embodiment including a double arcuate path of a carton from the hopper H on its way to the conveyor C. F2 illustrates a fully erected carton being moved by lugs 23 on the conveyor belt 20.

Figure 8:
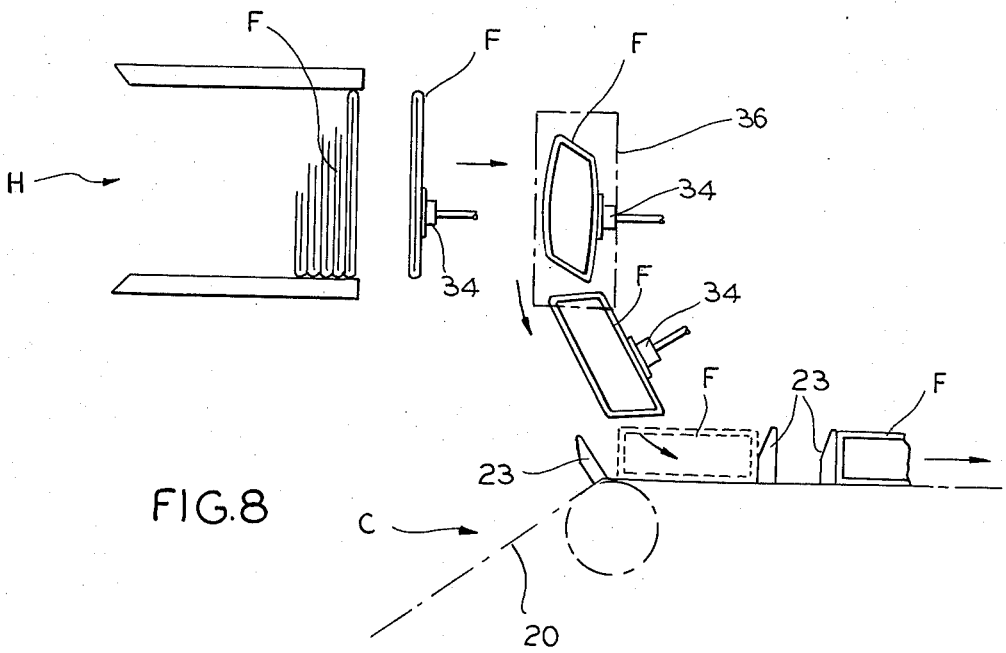
FIG. 8 is a schematic view illustrating a compound movement of a carton.

A still further embodiment is shown in FIG. 8 where a carton is moved by the vacuum pick-off devices 34 from the hopper past the stationary plenum 36 and onto the conveyor C in an out-and-down action with a compound motion. At the end of the initial horizontal stroke of the devices 34 the carton is positioned opposite the plenum 36.

I claim:

1. An apparatus for erecting carton tubes formed from foldably connected panel elements, said apparatus comprising:

(a) a hopper for holding a plurality of carton tubes in flattened condition;

(b) a conveyor adapted to receive an erected carton tube and having means for retaining said tube in an erected condition;

(c) a carton tube erecting and transfer structure mounted for movement in a path between said hopper and said conveyor for delivering an erected carton tube to said conveyor;

(d) said last named structure including:

(i) vacuum pick-off and transfer means movable in timed relationship to said conveyor for engaging a panel element of said tube disposed at said hopper;

(ii) said vacumm pick-off and transfer means moving in an arcuate path between said hopper and said conveyor;

(iii) stationary plenum means positioned along the path of travel of said carton tubes and located remote from and free from attachment to said hopper and acting at least during a portion of said movement of said vacuum pick-off and transfer means for applying air pressure upon at least one end of said carton tube to erect the same as said tube is transferred from said hopper to said conveyor.

2. The apparatus according to claim 1, wherein said means for retaining said tube in an erected condition includes lugs movably mounted on a conveyor belt.

* * * * *